US006580444B1

(12) United States Patent
Drynkin et al.

(10) Patent No.: US 6,580,444 B1
(45) Date of Patent: Jun. 17, 2003

(54) THERMAL PRINTER FOR COMPACT DISKS AND OTHER MEDIA

(76) Inventors: Alexander V. Drynkin, 1195 Lincoln Ave., Walnut Creek, CA (US) 94596; David Miller, 20 La Espiral, Orinda, CA (US) 94563

( * ) Notice: Subject to any disclaimer, the term of this patent is extended or adjusted under 35 U.S.C. 154(b) by 0 days.

(21) Appl. No.: 10/136,552

(22) Filed: Apr. 30, 2002

(51) Int. Cl.[7] ..... B41J 2/325

(52) U.S. Cl. ..... 347/171; 347/222; 347/197; 400/120.16

(58) Field of Search ..... 347/171, 222, 347/197; 400/48, 120.16

(56) References Cited

U.S. PATENT DOCUMENTS 5,317,337 A 5/1994 Ewaldt
5,518,325 A 5/1996 Kahle
5,542,768 A * 8/1996 Rother et al. ..... 400/120.16
5,797,688 A 8/1998 Wen
5,915,858 A 6/1999 Wen
5,927,208 A 7/1999 Hagstrom et al.
5,967,676 A 10/1999 Cutler et al.
6,019,151 A 2/2000 Wen et al.
6,148,722 A 11/2000 Hagstrom
6,302,601 B1 10/2001 Hagstrom et al.
6,312,174 B1 * 11/2001 Drynkin et al. ..... 400/120.16
6,447,181 B1 9/2002 Hagstrom et al.

* cited by examiner

*Primary Examiner*—Huan H. Tran
(74) *Attorney, Agent, or Firm*—Richard Esty Peterson

(57) ABSTRACT

A thermal transfer printer having a print head and a media support platform in the form of a removable tray that is displaced relative to the print head, the media support platform having a rigid support surface for a media item having a non-rectangular configuration such as a compact disk, the support platform having a mask with a cutout substantially in the shape of the non-rectangular disk, the mask and media item combining to form a contact surface for the print head to uniformly distribute a constant force of the print head in a uniform pressure across the mask and media item during printing, the mask providing, in addition, a holding apparatus for the media item which is contacted by a displaceable retainer urging the media item against the edge of the mask with the print head avoiding contact with the retainer on the printing area, the printer having a mechanism to displace the retainer and sense whether a media item is properly placed in the cutout and retained by the retaining apparatus, and the printer having a print head unit that can be flipped to the side of the printer for replacement of the print ribbon or access to the print head and internal components for maintenance and servicing.

26 Claims, 8 Drawing Sheets

THERMAL PRINTER FOR COMPACT DISKS AND OTHER MEDIA

BACKGROUND OF THE INVENTION

This invention relates to a thermal printer of the type described in U.S. Pat. No. 6,312,174 B1, entitled "Thermal Printer For Compact Disks" issued Nov. 6, 2001.

This invention relates to a thermal transfer printer for printing on the surface of a compact disk and other media using a linear thermal transfer head.

The invention optimizes printing on irregularly shaped media and incorporates features to prevent damage to the thermal transfer print head and to facilitate ease of use and maintenance.

Compact disks are an inexpensive medium for storing digital information that may relate to audio, video and/or any type of information or data that is conveniently stored in digital form. When compact disks are manufactured in large quantities, the side opposite the recording side of the disk is customarily printed in a mass printing process such as silk screening. The label information applied to the disks is generally identical for each disk and related to the pre-recorded content of the disks.

With the development of the CD-R disk, disks can be sold in blank with the informational content later recorded by a CD-R recorder. In order to appropriately label such disks with regard to the content that is recorded on the disk, programmable disk printers, such as ink jet printers and thermal transfer printers have been devised. These printers print the surface of the disk with graphics and other information that can be customized to correspond to the information recorded on the disk by the CD-R recorder. One drawback in using an ink jet printer is the extended time required to print an individual disk. Another drawback is the additional expense of disk blanks, which require a precoated surface for ink jet printing. Additionally, use of inks that are water resistant is difficult and expensive requiring specialty print heads.

Thermal transfer printers can print with greater speed and print on disks prepared with an inexpensive lacquer coating. Thermal transfer printers include a print head that applies a contact pressure to the media to be printed.

One type of thermal transfer printer will typically consist of a mechanism that has a stationary print head, a ribbon, and assembly that moves the media under the print head. The print head contains an array of heating elements. The ribbon is a plastic film with a wax or resin compound deposited on one side. The print head is in contact with the ribbon during printing, and the ribbon is in contact with the media.

By heating the areas of the ribbon, the was or resin compound is deposited on the media. Printing occurs by moving ribbon and the media at the same rate across the print head, while firing the heating elements in a desired pattern. The print head must exert some pressure on the media for successful transfer of the wax or resin to the media.

A second type of thermal printer is a direct transfer printer, which uses thermally sensitive media that changes color when heated, therefore a ribbon is not required. With thermally sensitive media, the print head marks the media by generating a pattern of heated and non-heated areas on the surface of the media, as it moves under the print head. The invention described is applicable to both types of thermal printers.

Thermal transfer printers require the print head to contact the printable surface at a uniform pressure for optimum transfer of a marking medium from a ribbon to the media (or heat in the case of direct thermal transfer printer). Variations in print head pressure to the media result in improper printing on media such as non-printed areas or uneven print density.

Printing on rectangular objects, such as a piece of paper, is relatively straight forward, since the print head pressure remains constant during the entire printing process. The pressure remains constant because the area of contact between the print head and the media does not change. For example, in printing a 5" wide piece of paper the print head is always in contact with 5" of media. In contrast, printing on a 5" diameter disk, the area of contact would initially be very small as the print head is at the edge of the disk, but then increases to 5" as the print head crosses the center of the disk. After crossing the center of the disk, the area of contact decreases as the print head travels the far edge of the disk.

When the force of the print head applied to the media is constant and the print head travels across a rectangular shaped media, the pressure per unit area is constant. If the print head travels across a disk shaped media, the print head pressure to the media will change as the print head travels across the disk. When the force of the print head applied to the media is constant and the print head travels across a disk shaped media the pressure per unit area changes as the contact area increases and decreases.

To successfully print on disk shaped media, the printer must be constructed to either:

a) vary the force of the print head applied to the media as it travels across the disk to compensate for the variation in width of printable surface, or b) hold the disk in a manner that effectively presents an unchanging width of contact area for the print head as it moves across the disk.

The process described in point a) can be achieved by using a complicated system of cams, gears and sensors.

The process described in point b) can be achieved by using a simple system based on the invention that incorporates a media holding tray that puts the print head in contact with the media and a supplemental surface. The combination of the surfaces which are in contact with the print head present a surface of uniform width (width that does not change as the disk is printed). This supplemental surface comprises a mask that has a thickness and structural characteristics that are substantially the same as the media.

The invention described below consists of a thermal printer that utilizes a tray type of media holder with materials arranged in such a manner as to maintain a uniform print head pressure to media as the media moves relative to the print head.

The media to be printed is placed manually or robotically in the media tray which consists of a base layer of compressible material (mounted on either a platform or platen) and a second mask layer of material similar to the thickness and composition of the media. The mask layer has a cutout in which the media is positioned. This arrangement allows the printable surface of the media to be at the same level as the unmasked areas of the compressible surface.

The key feature of this arrangement is that as the print head passes over the media, the area of contact between the print head and the sum of the areas of the media and the surface of the media holder remains constant. This results in uniform (unchanging) print head pressure on the media during the entire printing process.

By careful selection of the materials of the media holder, the proper print head to media pressure can be maintained without the use of complex print head pressure control systems. In addition, proper print head pressure can be maintained when printing odd shaped, non-rectangular media, such as disk shaped objects, where the print head's area of contact with the media varies as the print head moves relative to the disk.

The base layer (compressible surface) and the mask layer (surface with cutout area in the shape of the media) may have one or more layers of material, so long as the surface of the mask layer has similar mechanical characteristics to the item being printed.

A typical composition of the base layer would consist of a material that compresses to the appropriate degree needed to maintain proper print head pressure distribution on the media. The preferred embodiment for the disk printing application would require a base layer material that has a compression value of 40–70 durometer which could include materials such as neoprene and other rubber-like substances.

A typical configuration of the mask layer would consist of a material that does not compress or has the same compression characteristics as the media. The preferred material for the mask layer of the disk printing application is a non-compressible material such as polycarbonate. CD-ROM and CD-R disks are typically made from molded polycarbonate.

SUMMARY OF THE INVENTION

The thermal printer of this invention is designed to print on various configurations of media, and in particular, on disk shaped media, such as a compact disk. The invented printer resolves the problem of printing with a uniform pressure across irregular shaped media. The unique features of this invention include a print head chassis that flips open for easy replacement of the print transfer ribbon and maintenance and servicing of the print head and internal components. Additionally, the improved thermal printer includes a replaceable media transport carrier in the form of a removable tray.

The thermal transfer printer of this invention includes a rigid carrier having a flat media support surface with a resilient base layer and a top mask layer. The top mask layer has a media mask with a cutout having a configurations that matches the configuration of the media item to be printed. The media mask is fabricated from a material having physical and structural characteristics that are substantially the same as the media item being printed. Additionally, the media mask has a thickness that matches the thickness of the media item. In certain applications, the media item may require a topographically tailored media support surface. The feature of the removable support tray permits a variety of trays with different tray templates to be provided including trays with custom, multi-level, complex support configurations to optimize print transfer.

In this manner, the thermal contact element in the print head of the thermal transfer printer distributes its contact force across both the media item and the mask. The resulting pressure per unit area applied to the media item thereby remains constant during each advance of the carrier relative to the contact edge of the print head.

Additionally, the thermal transfer printer of this invention includes an improved retaining mechanism to retain a media item in position during the printing process. The retaining mechanism is designed to avoid damage to the fragile thermal resistors forming the linear array of pixel generating elements in the contact edge of the print head.

The retaining mechanism includes a centrally located retainer that is activated to hold the media item against the edge of the media mask. The retainer is part of a retainer mechanism that is incorporated into the removable tray and is connected to a latching mechanism in the printer for operation. In the case of a compact disk having a circular perimeter, the mask includes two small edge protuberances that project into the complimentary circular shaped cutout area of the mask layer opposite the retainer. The retainer, in the form of a button when used for compact disks is activated against the edge of the disk to urge the disk against the protuberances, thereby positioning the disk on the centerline between the protuberances.

This arrangement avoids the use of multiple contact pins that may damage the fragile pixel generating elements in the contact edge of the thermal print head. In the improved printer the retainer is positioned at the leading edge of the disk which is printed as the tray is retracted into the printer. With this system, the printer is able to place the contact edge of the print head at the leading edge of the disk just behind the single disk holding button. This allows the disk to be printed with no chance of collision between the media holding retainer and the print head.

The invented transfer printer also includes a mechanism to detect the carrier position and detect whether a media item is properly positioned on the carrier before contact by the print head. The detection mechanism is incorporated into the improved actuatable retainer mechanism to hold the media item in place during printing. Other embodiments of a retainer include a shuttle bar for straight edge media such as truncated disks and rectangular recordable media popular for business cards, specialty jigs for tags and other printable items collectively defined as media items as described herein. These and other features are described in greater detail in the detailed description of the preferred embodiments that follows.

DETAILED DESCRIPTION OF THE PREFERRED EMBODIMENTS

Figure 1:
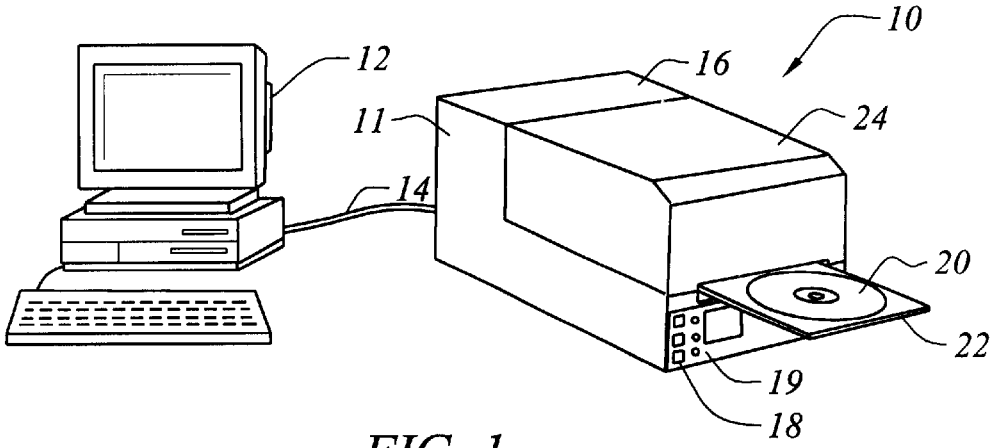
FIG. 1 is a perspective view of the thermal printer of this invention and a connected general purpose computer.

The thermal transfer printer of this invention is shown in one preferred embodiment in FIG. 1 and is designated generally by the reference numeral 10. The thermal transfer printer 10, hereafter, thermal printer, is shown coupled to a general purpose computer 12 by a cable 14. The general purpose computer 12 conveniently carries an application program to create and manage graphic images and text that are to be transferred to the media by the thermal printer 10. An ordinary personal computer is typically adequate for creating labels for compact disks, the primary use for which this printer was invented.

The thermal printer 10 has an external housing 16 with a control panel 18 for entry of user commands and display lights 19 for visual feedback of user entries and prompts generated by the printer 10. Within the thermal printer 10 is housed a controller 11 that coordinates the electronic and mechanical operations involved in the automated printing of a media item. The most common media item is a recordable compact disk 20 shown in the extended media holding tray 22 for the embodiment of the print tray 22 shown in FIG. 1. The thermal transfer printer of this invention is designed to print on non-rectangular shaped media and, as noted, is particularly adapted to print label information on compact disks. The printer embodiment described utilizes a ribbon having a thermally sensitive transfer coating that is transferred from the ribbon to the media when heated by a print head.

Figure 2:
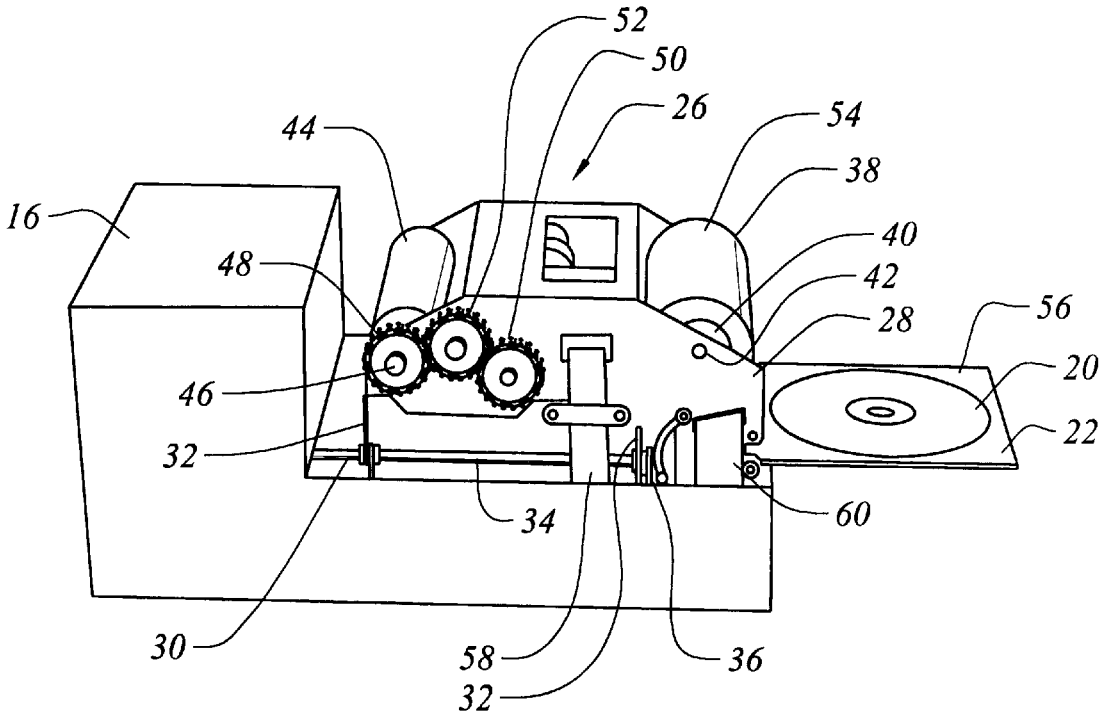
FIG. 2 is a perspective view of the thermal printer of FIG. 1 with a cover to the print head unit removed.

The external housing 16 includes an easily removable cover 24 to provide access to the print head unit 26 shown in the perspective view of FIG. 2 with cover removed. The print head unit 26 has a print head chassis 28 that is mounted on top of and pivotally connected to a main print tray drive and controller chassis 30. A pivot mechanism 29 that includes bracket tabs 32 which engage a pivot rod 34 is mounted on the side of the main chassis 30. The pivotal connection of the print head unit 26 enables the print head unit 26 to be flipped to the side of the main chassis 30 for replacement of the print ribbon or access to the internal components of the printer for maintenance or servicing. A pin and slot stop mechanism 36 limits the pivot of the print head chassis for convenient access to the underside of the print head chassis and internal components of the main chassis.

As shown in FIG. 2, the printer 10 has an easily replaceable print ribbon supply roller 38 carried on a spindle 40 having one end that seats in a slot 42 and the other end in a bearing (not visible) at the other side of the chassis 28. A take-up roller 44 is mounted on a spindle 46 on which is mounted a gear 48 that is driven by a motor gear 50 through an intermediate idler gear 52. In the improved thermal printer 10 of this invention, the disk 20 seated in the print tray 22 is printed as the tray is retracted into the printer. In this manner, the take-up roller 44 draws the print ribbon 54 from the print ribbon supply roller 38 at the same speed of tray travel to prevent smearing as the print head presses against the transported media and a media mask 56. The controller 11 (shown in FIG. 3) is located under the housing 16 in the main chassis and coordinates the printing operation. The controller 11 is electronically connected to the print head unit 26 through a ribbon cable 58. Similarly, the user commands from the control panel 18 are electronically connected to the print head unit 26 and controller 11 through a ribbon cable 60.

Figure 3:
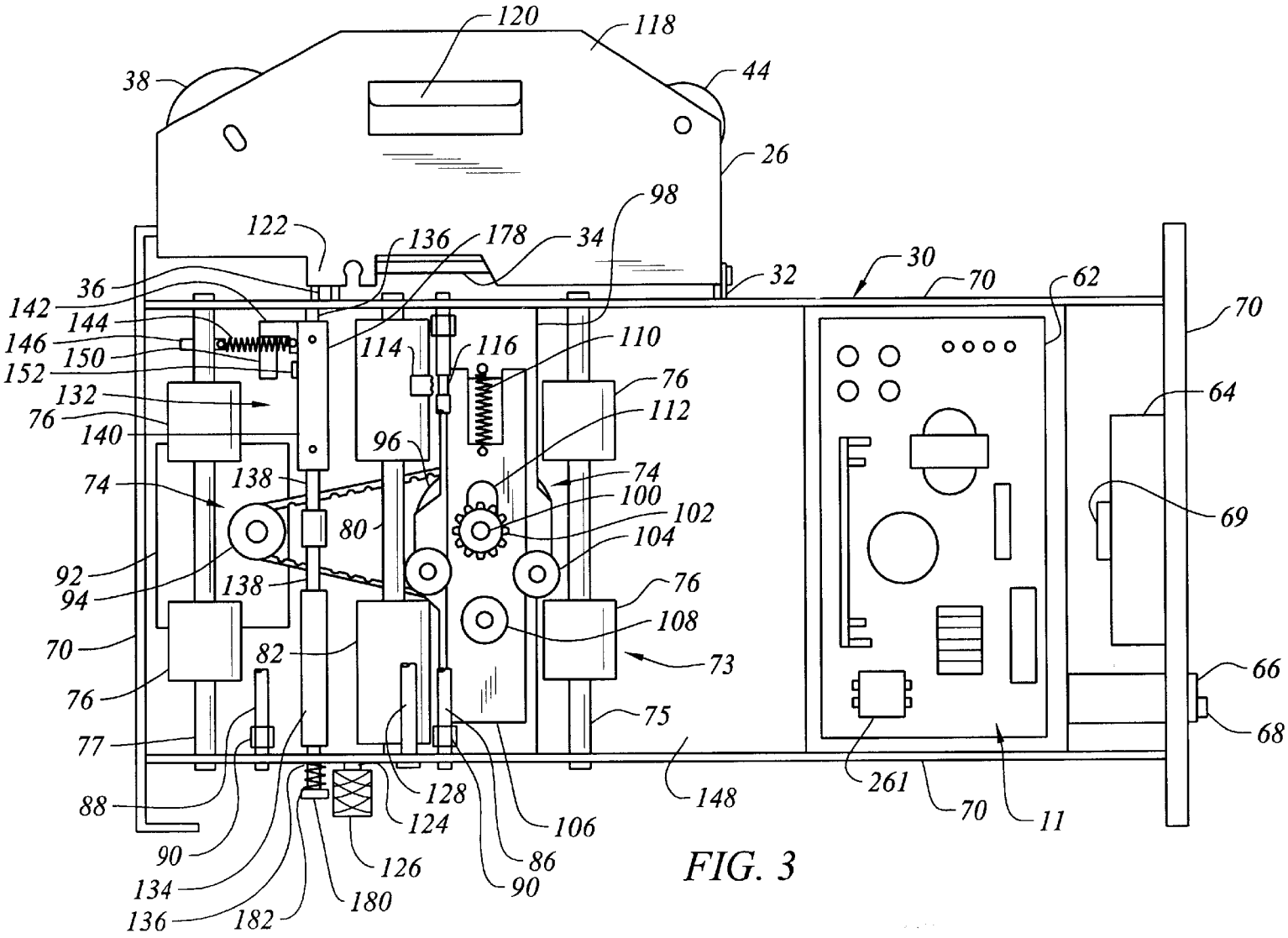
FIG. 3 is a top view of the thermal printer with the housing removed and the print head unit pivoted to one side.

Referring now to FIG. 3, a top view of the thermal printer 10 with the housing and print tray removed is shown. The print head unit 26 is pivoted to a vertical, out-of-the- way position. The pin and slot stop mechanism 36 ordinarily limits the pivot to a position less than perpendicular, and the exaggerated pivot is shown for purposes of this description to prevent the print head unit 26 from obscuring the internal components of the main chassis 30. With the housing 16 removed, the electronic controller board 62 for the controller 11 is mounted in the chassis next to a fan 64 and a power supply connector 66 with an on/off power switch 68. Under the fan 64 is a tray sensor 69 to sense the home position of a retracted tray.

The main chassis 30 has ends 70 and side walls 72 for mounting the print tray support mechanism 73 and the print tray drive mechanism 74. The side walls 72 provide shaft bearings for the components that support and guide the transport of the tray 22. Spaced roller shafts 75 and 77 have spaced rubber rollers 76 which engage the underside of the removable tray 22 on each side of a rack unit 78 shown in FIG. 4. Between the spaced roller shafts 75 and 77 is located a roller shaft 80 with spaced elongated rubber rollers 82 for support of the removable tray 22 under the contact location of the print head shown in FIG. 5.

The top of the removable and replaceable tray 22 is retained by two spaced guide shafts 86 and 88, shown in part in FIG. 3. The guide shafts 86 and 88 include small plastic contact rollers 90 that engage the media mask 56 on the top of the tray 22.

Figure 4:
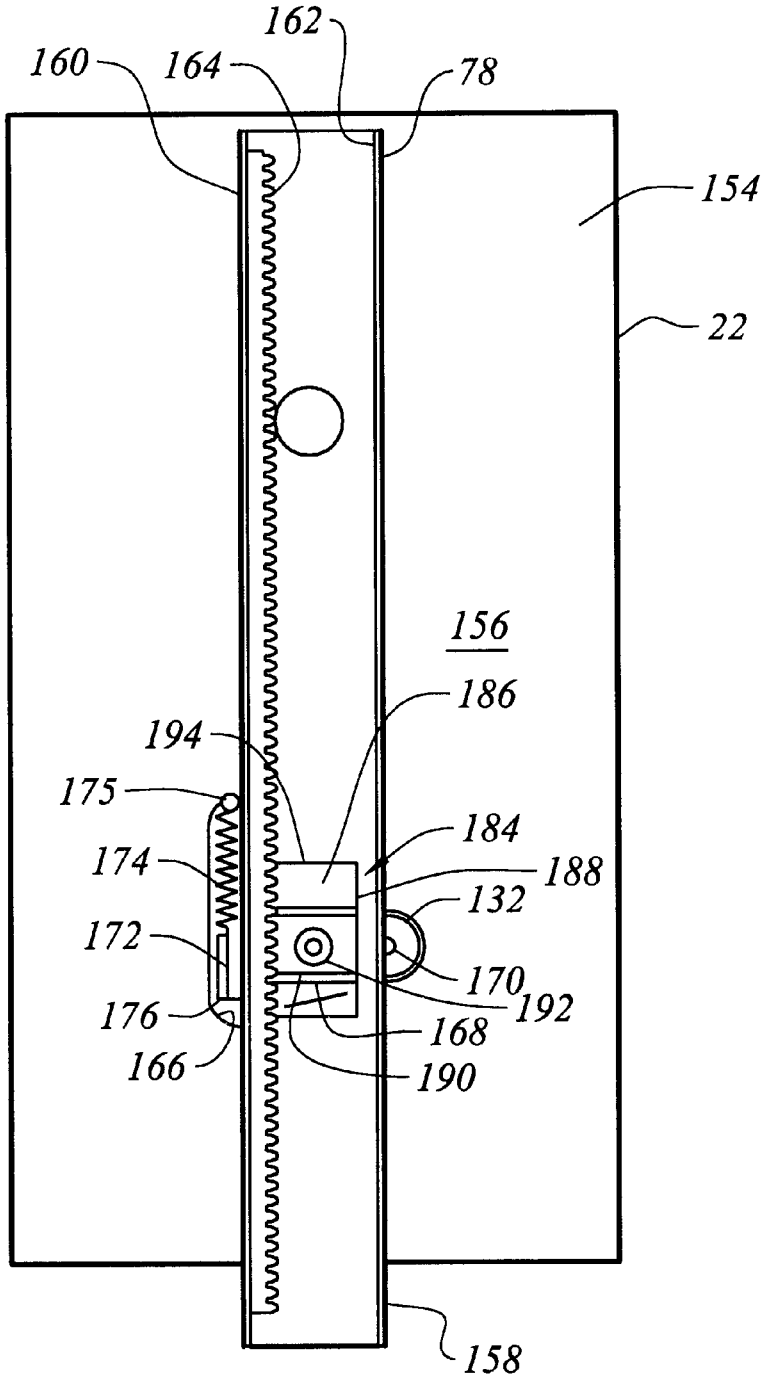
FIG. 4 is a plan view of the underside of the typical print or media tray removed from the thermal printer.

A print tray drive mechanism 74 for accurately moving the tray in and out of the printer 10 under the print head unit 26 cooperates with the rack unit 78 shown in FIG. 4. The drive mechanism 74 includes a stepping motor 92 with a belt sprocket 94 that drives a driven sprocket 96 under a mounting plate 98. The driven sprocket 96 has a shaft 100 that is common to a pinion gear 102. The pinion gear 102 cooperates with two spaced guide rollers 104 to maintain the linear travel of the tray when in engagement with the rack unit 78. Supported on the mounting plate 98 is a slide plate 106. The slide plate 98 carries a nylon pressure roller 108 that is biased by a tension spring 110 connected at one end to the mounting plate 98 and at the other end to the slide plate 106. The slide plate 106 has a slot 112 for the common shaft 100 to enable the slide plate 106 to displace under the pinion gear 102. In this manner, the pressure roller 108 and guide rollers 104 cooperate to maintain the engagement of the drive mechanism 90 with the rack unit 78.

Above the drive mechanism 74 is a support plate (not shown) spanning the two side walls 70 for positioning a reflective tab 114 that is shown in part in FIG. 3. The reflective tab 114 seats in a notch 116 on the guide shaft 86 to avoid contact with the ribbon. The reflective tab 114 cooperates with a photo sensor (not shown) in the print head unit 26 to signal when the print ribbon 54 has run out, or that the print head chassis 28 has been pivoted up from the main chassis 30.

The print head unit 26 has a side 118 with a handle 120 allowing the print head unit 26 to be easily flipped to the side when the cover 24 is removed. In order to ensure that the print head unit 26 is not inadvertently dislodged, the side plate 118 includes a notched tab 122 that engages the threaded shaft 124 of a chassis lock knob 126.

Figure 5:
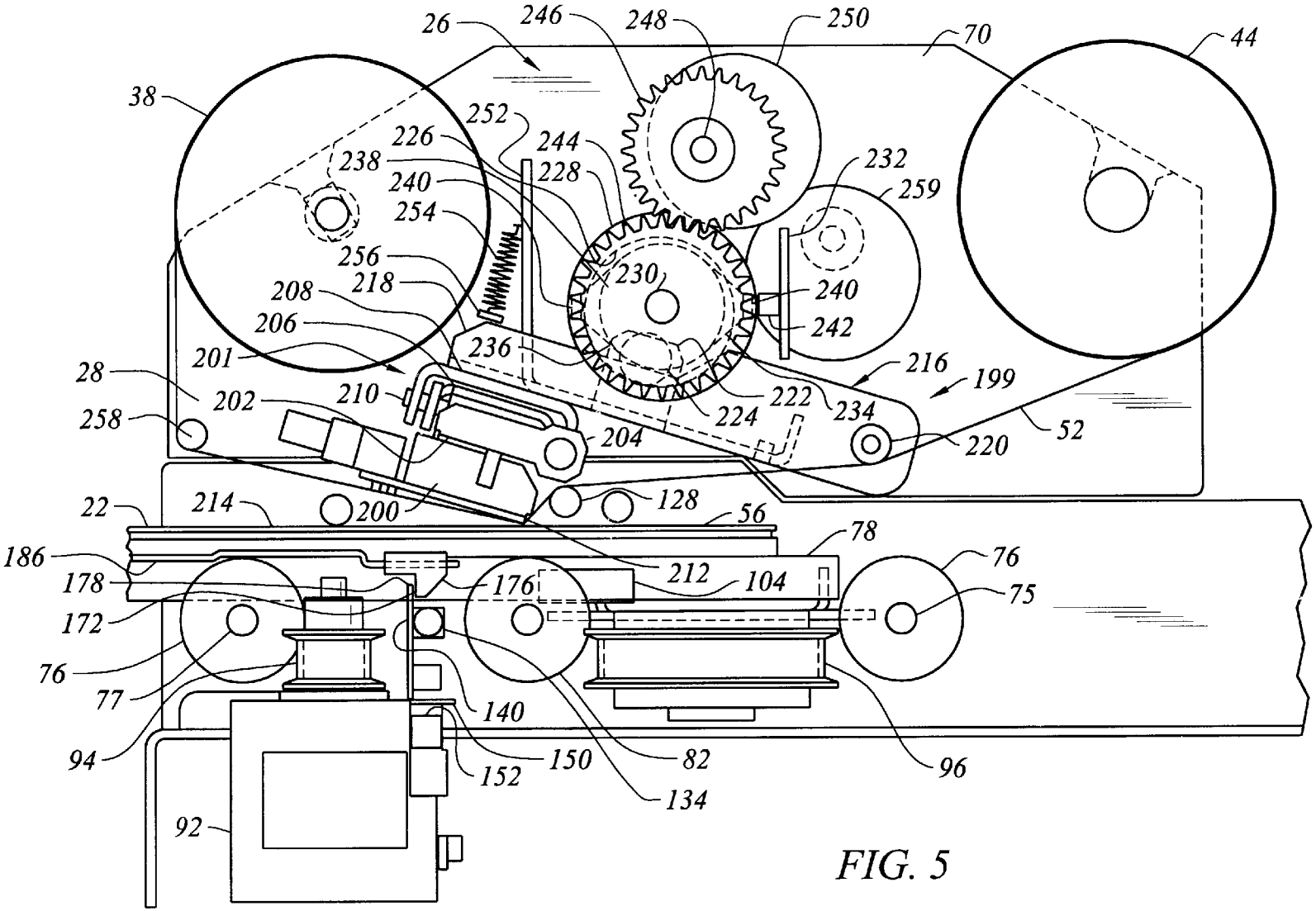
FIG. 5 is a partial elevational view schematically illustrating the print head displacement mechanism and tray drive mechanism.

When the print head unit 26 is lowered to its operating position a rod roller 128 engages and lifts the print ribbon 54 behind the print head 130, a shown in greater detail in FIG. 5.

In order to insure that the tray 22 when inserted is not inadvertently dislodged, a latching mechanism 132 is provided. The latching mechanism 132 includes an elongated square rod 134 with cylindrical ends 136 and a pair of central by-pass segments 138 to clear the rack unit 78. The rod 134 carries a screw mounted latch plate 140. The latch plate 140 has an end tab 142 connected to a tension spring 144 that is connected to a bracket tab 146 on the bottom 148 of the main chassis 30. The end tab 142 includes a downwardly directed flag 150 that is pivoted to a photo-sensor 152 under the rod 134 when the latching mechanism 132 is in engagement this typically occurs when the tray 22 is extended for receipt of or removal of a media item.

Referring to FIG. 4, the underside 154 of the media tray 22 is fabricated from a rigid, preferably metal, support plate 156. The rack unit 78 includes a U-channel or track 158 mounted on the surface of the support plate 156. The guide track 158 has two rails 160 and 162. When the removable tray 22 is installed, rail 160 engages the guide rollers 104 and pressure roller 108, displacing the slide plate 106 so that the rail 160 tracks between the spring biased pressure roller 108 and the pair of guide rollers 104. Mounted along the inside of rail 160 is a nylon rack 164. On installation, the rack 164 engages the pinion gear 102 of the drive mechanism 74, which then displaces the tray 22 on rotation of the gear 102 by the stepping motor 92. In this manner, movement of the tray 22 is accurately controlled by controlled operation of the stepping motor.

Under and adjacent the track 158 is the cooperating latch portion of the latch mechanism 132. Seated in a recess 166 in the support plate 156 under the track 158 is a latch arm 168 mounted on a pivot pin 170. The contour of the recess 166 limits the pivot of the latch arm 168. At the distal end of the latch arm 168, adjacent the rail, is a perpendicular latch hook 172. A tension spring 174 that is anchored to the support plate 156 by screw 175 is connected to the hook 172. The latch hook 172 is configured with an angled lead edge 176, as shown in FIG. 5, to contact the latch plate 140 on inserting the removable tray 22 and rotate the square rod 134 allowing the latch hook 172 to clear the latch plate 140. The tension spring 144 connected to the latch plate 140 biases the square rod 134 to position the latch plate 140 at an angle. As shown in FIG. 3, the latch plate 140 has a trailing edge 178 that overhangs the square rod 134. As the media tray 22 is extended from the printer housing 16 the latch hook 172 snags the trailing edge 178 of the latch plate 140 and limits further displacement of the tray 22 from the main chassis, as shown in FIG. 5.

The latch hook 172 can be released from engagement with the latch plate 140 by pressing a release button 180 on the extended end 136 of the square rod 134 which displaces the rod along its axis and positions the latch hook 172 at the adjacent, by-pass segment 138. The latch hook 172, biased by the tension spring 174, clears the necked-down segment 138 of the rod 134, allowing removal of the tray 22. A compression spring 182 under the release button 180 returns the square rod to its normal axial position.

In conjunction with latching the tray to restrict displacement, the latch portion of the latch mechanism 132 actuates the retainer mechanism 184 for holding the media item on the tray 22. The pivoting latch arm 168 is linked to an elongated tongue 186, which is linearly displaceable in a guide channel 188 under the track 158 of the rack unit 78. One end 190 of the elongated tongue 186 is raised displaceable in a slot 194 in the track 158. The tongue 186 transfers the angular displacement of the spring biased latch arm to a linear displacement of a media retainer 196 on the topside 198 of the tray 22, as shown in FIGS. 6–9. When the tray is extended and the latch hook 172 is engaged with the latch plate 140, the limited additional travel of the tray against the bias of the latch arm spring 174 retracts the retainer 196 allowing placement or removal of the media item from the tray 22.

Referring to the enlarged schematic view of FIG. 5, the print head displacement mechanism 199 for the printer 10 is shown with the print head unit 26 in its operating position and a thermal print head 200 displaced to its print position against the media mask 56 of the media tray 22. The media tray 22 is shown in part extended to illustrate the engagement of the latching hook 172 with the pivoted latching plate 140 on the square pivot rod 134. Normally, the tray 22 would be further withdrawn into the printer before the print head 200 is lowered against the tray 22 for printing. Operation of the print head is controlled by the programmed controller 11.

The fragile thermal print head 200 is mounted on a carriage assembly 201 of the print head displacement mechanism 199. The thermal print head 200 is fastened to an inner mounting plate 202 having end hinges 204 coupled the inner plate to an intermediate bracket 206. The coupled mounting plate 202 and intermediate bracket 206 are connected to an outer bracket 208 by a transverse pin 210 to allow some limited side-to-side wobble to the print head 200 for distributing the force of the contact edge 212 of the print head uniformly across the top surface 214 of the tray 22 during printing.

The outer bracket 208 is fastened to a pivotal carrier sled 216 with side arms 218 coupled to a pivot rod 220 spanning the side walls 70 of the print head chassis 28. A central tab 222 on the carrier sled 216 carries a roller 224 that engages the eccentric inside cam surface 226 of a cam wheel 228. The cam wheel 228 is mounted on a shaft 230 that is carried on an assembly bracket 232 (shown in part) mounted to the print head chassis. The shaft 230 also carries a sensor flag unit 234 having a dark inner spacer wheel 236 and a disk plate 238 having two oppositely directed perpendicular flags 240 spaced one hundred eighty degrees apart. The flags 240 selectively align with one of a pair of photo sensors 242 located on the bracket 232. A driven gear 244 is also mounted on the cam wheel shaft 230 which engages a drive gear 246 on the drive shaft 248 of a d.c. drive motor 250. Operation of the drive motor rotates the drive gear 246 which drives the driven gear 244 to rotate the cam wheel 228 that raises or lowers the carrier sled 216 and mounted print head 200. The flags 240 indicate the position of the cam wheel 228 when one of the oppositely positioned flags is in proximity to its photo sensor 242, thereby selectively indicating the raised or lowered position of the print head 200 to the controller 11.

An angled yoke 252 of the carrier sled 216 provides a mount for one end of one or more tension springs 254. The tension springs 254 are connected at their opposite ends to an internal anchor mount 256 (partially shown) projecting from the print head chassis 28. The springs 254 are selected to pull the carrier sled 216 downwardly, forcing the carrier sled roller 224 against the inside cam surface 226 of the cam wheel 228. The springs 254 limit its downward force of the print head 200 against the tray surface 214. If this force is exceeded, for example, when the print head engages a dislodged disk, the print head will rise against the force of the springs to avoid excessive damage to the print head.

The print ribbon 54 from the supply roll 38 is carried over a rod roller 258 rotatably mounted to the print head chassis 28 and under the contact edge 212 of the print head 200. The print ribbon 54 is then lifted by the rod roller 28, guided by the pivot rod 220 of the carrier sled and wound on the take-up roll 44. The take-up roll 44 is gear driven by the d.c. drive motor 259. Tension in the print ribbon 54 is limited by a spring clutch (not shown) in the spindle 40 of the supply roll 38. Control of the d.c. drive motor 259 is coordinated with the positioning of the print head 200 by the programmed controller 11. The controller generally includes basic program instructions generic to the various applications of the printer. Certain tasks such as graphics and print generation are preferably performed using the auxiliary computer 12.

However, the printer 10 includes a memory buffer 261 on the controller board 62 to capture the last label graphic for continuation or restart of a printing operation. The controller 11 can have full personal computer capability with an auxiliary display or small integrated display, thereby dispensing with the external computer 12.

This flexibility in controlling operations is beneficial for tailoring the printing operation to different media items. The replaceability of the printing tray enables the printer 10 to be adapted to thermal printing of a variety of media items as exemplified in FIGS. 6–9.

Figure 6:
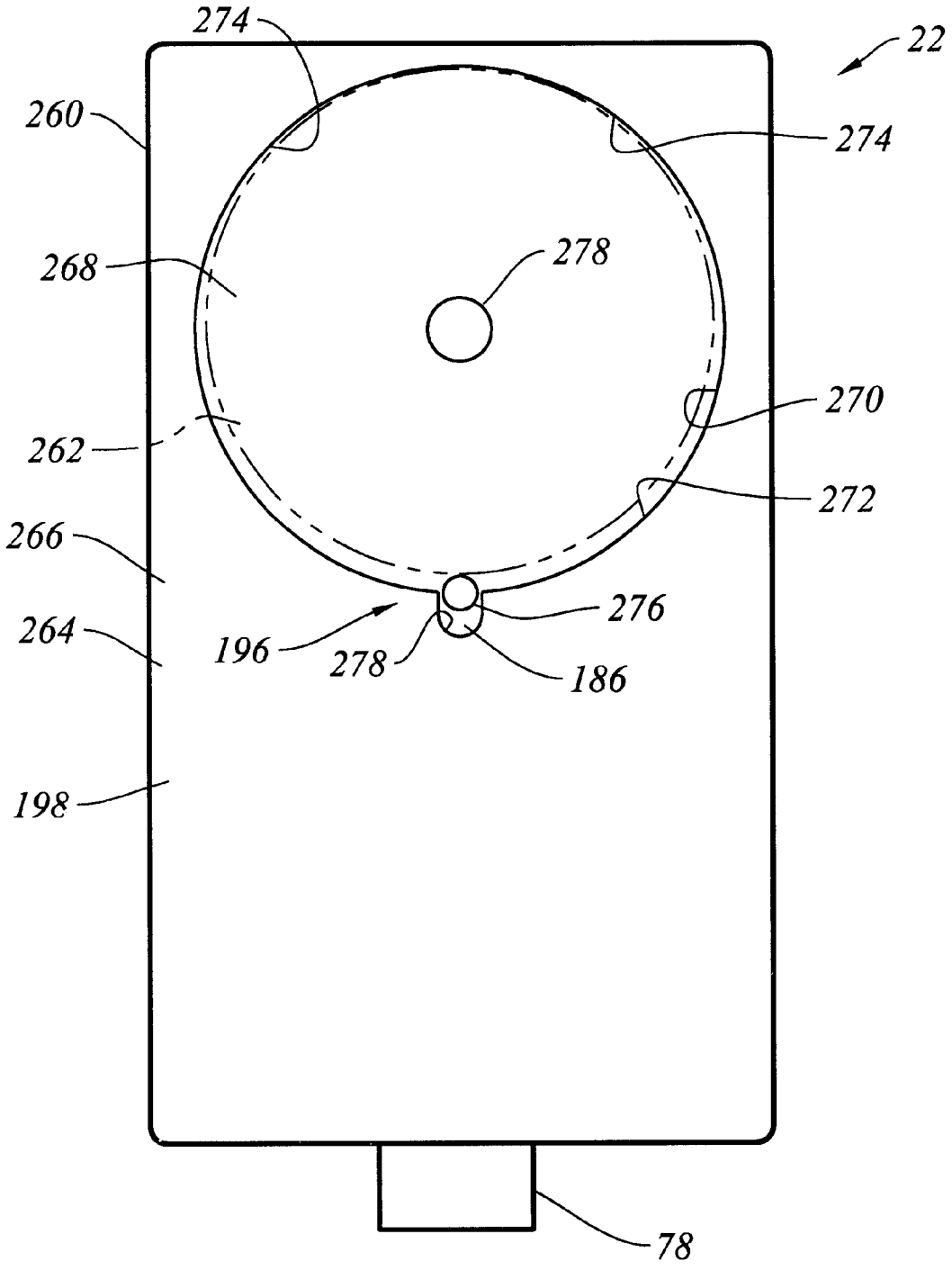
FIG. 6 is a plan view of one embodiment of the print or media tray for a typical compact disk.

Referring to FIG. 6, the embodiment of the removable tray 22 is in the form of a standard compact disk tray 260 with a five inch compact disk 262 having approximately a 4¾" diameter outline shown in phantom. The tray 260 has a top surface 264 primarily comprising a media mask in the form of a stiff, non-compressible mask layer 266 fabricated of a plastic, such as polycarbonate, having structural characteristics similar to those of the compact disk.

A moderately compressible base layer 268 is exposed in the cut-out 270 of the mask layer 266. The cut-out 270 is in a template configuration 272 for a compact disk. The CD template configuration 272 provides an oversized opening for seating a disk manually or robotically. To position the disk 262 for printing, a pair of small protuberances 274 in the cut-out 270 provide a two point contact for seating the disk 262 during printing. At the opposite side of the cut-out 270 is located the media retainer 196 in the form of a flat button 276 carried on the spring loaded tongue 186. When actuated on extension of the tray, the button 276 retracts into a slot 278 in the mask layer 266 and base layer 268 allowing placement of the disk 262. When the tray is retracted into the printer for the printing process the button 276 engages the edge of the disk and holds the disk firmly against the protuberances 274 with the selected force of the tension spring 174. A hole 279 through the tray 22 is provided for compact disks of various sizes and configurations to facilitate removal. The underside of the tray 22 includes the rack unit 78 as described with reference to FIG. 4. A similar arrangement with a cut-out having a smaller template configuration can accommodate a 3" CD using a button retainer as shown in FIG. 6.

Figure 7:
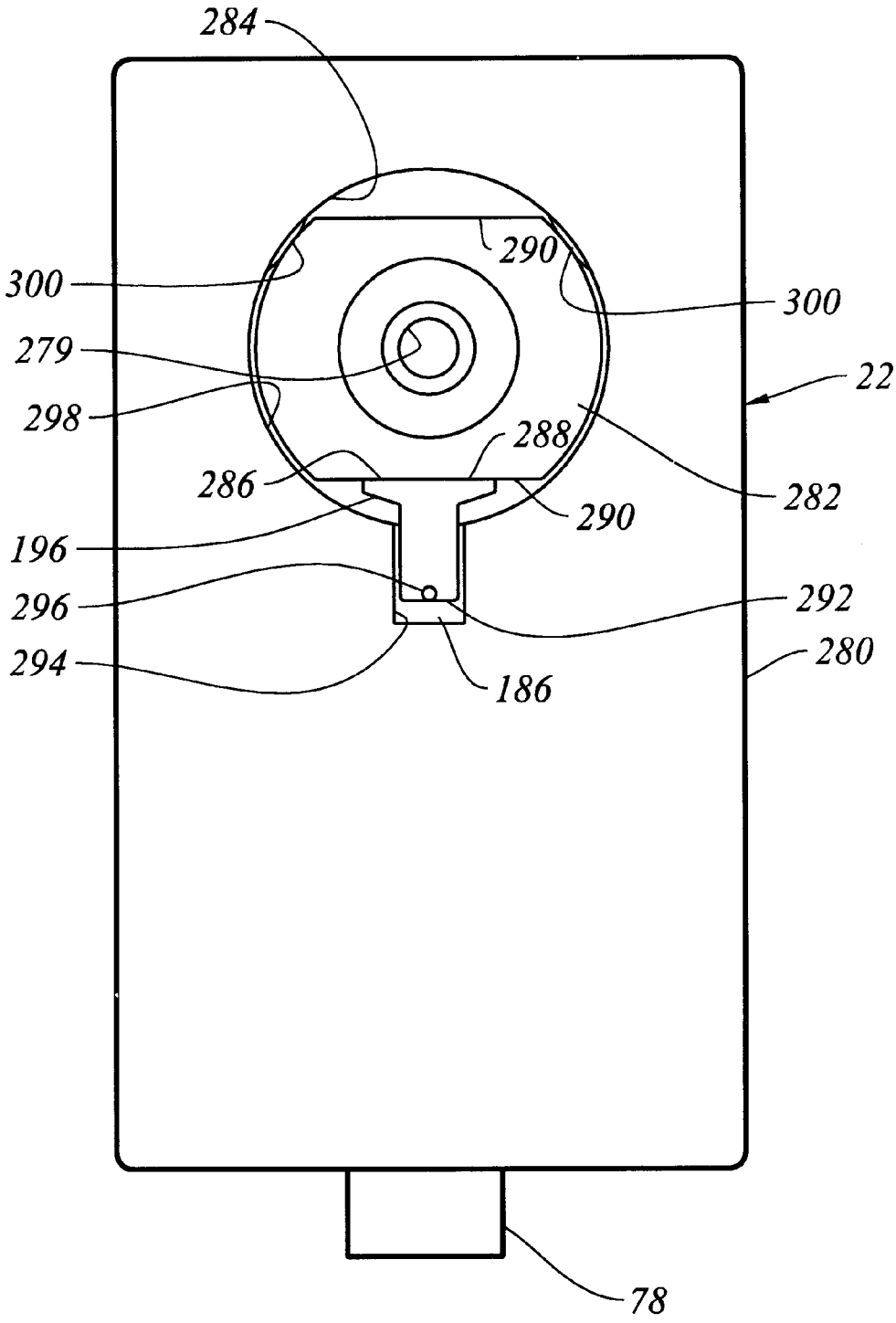
FIG. 7 is a plan view of another embodiment of the print or media tray for a truncated disk, commonly used as a business card.

Referring to FIG. 7, the embodiment of the removable tray 22 is in the form of a compact disk business card tray 280 which receives a truncated 3" compact disk 282 in a cut-out 284 for a 3" compact disk. The tray 22 is modified with a media retainer 196 in the form of a flat shuttle 286 with a straight contact edge 288 that contacts one of the opposite straight edges 290 of the truncated disk 282.

The flat retainer shuttle 286 has a tab 292 that retracts into a slot 294 and is connected to the actuator tongue 186 by a pin 296. The template configuration 298 of the mask layer 266 of the media mask 56 includes protuberances 300 and is designed to accommodate a truncated disk 282. The tray 280 has a hole 279 and underside with a rack unit 78 similar to that described with reference to FIG. 4.

Figure 8:
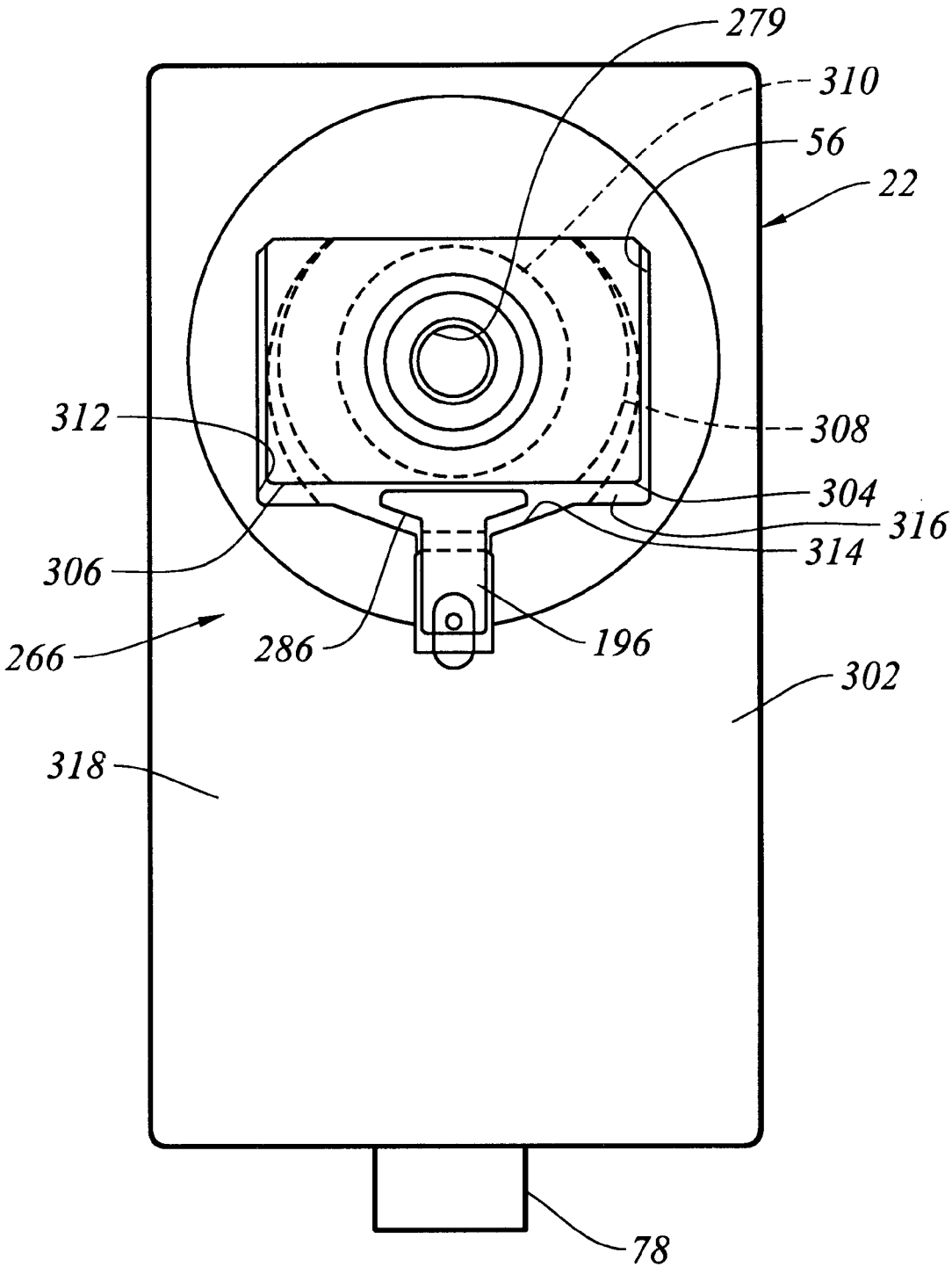
FIG. 8 is a plan view of another embodiment of the print or media tray for a rectangular business card.

Referring to FIG. 8, the embodiment of the removable tray 22 is in the form of a rectangular card, compact disk tray 302. The rectangular compact card disk 304 is a newly popular media item for business cards. The form is generally rectangular with rounded corner segments 306 which are thinner than a central, truncated disk portion 308 which includes an inner circular recording area 310, shown in dotted line.

This stepped topography on the underside of the rectangular card disk 304 requires a media mask 56 with the mask layer 266 having a matching template configuration 312 with a complex topography. A complex topography is one having multiple levels. The template configuration 312 has a cut-out 314 and corner seats 316 provided by milled recesses in the mask layer 266, such that the flat top surface of the compact card disk 304 is supported substantially flush with the top surface 318 of the mask layer 266. A template configuration with a complex topography matching the topography of the media item allows a substantially even pressure to be applied by the print head across the media item during thermal printing.

The rectangular card disk tray 302 has a retainer 196 in the form of the flat shuttle 286, as shown in FIG. 7, and includes a similar tray hole 279 as in the previous embodiments.

Figure 9:
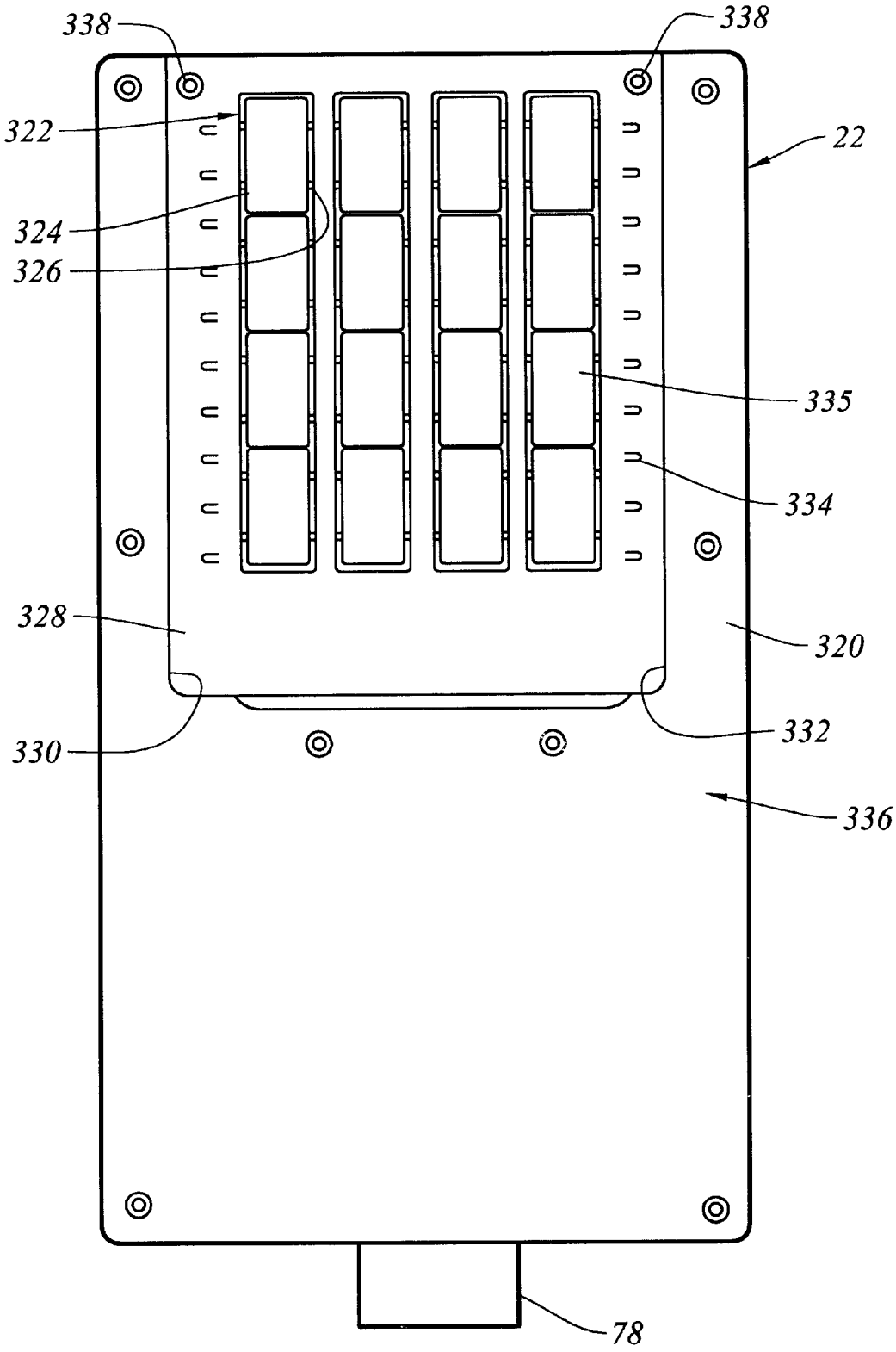
FIG. 9 is a plan view of another embodiment of the print or media tray for a tag array carried on a jig.

Referring now to FIG. 9, the embodiment of the removable media tray 22 is in the form of a general media item tray 320. In the particular example of FIG. 9, the general media item tray 320 supports a preformed tag array 322 with a matrix of pre-cut tags 324 on snap-off tabs 326. The preformed tag array 322 is seated on a metal printing jig 328 that seats in a mask cut-out 330 having a template configuration 332 conforming to the outline of the jig 328. The jig 328 has a recess 334 with a milled complex topography matching the underside of the tag array to present a top surface 330 of the tags 324 flush with the mask layer 336. The mask layer 336 is selected to have structural characteristics similar to the combined jig and media item.

The jig 328 is maintained in position by a retainer in the form of pins 338, which are flush with the jig 328 to avoid damage to the print head. The tray hole 279 is omitted unless desirable to facilitate dislodgment of the jig and carried media item. Where the underside of the media item is flat, the jig may be omitted and the item retained by the mask area directly on the base layer.

These embodiments of the removable media tray are described as examples of the variety of different media items that are suitable for printing with this thermal printer and are not intended to limit the scope of the invention defined in the claims.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A thermal printer for thermal printing on a variety of types of differently shaped media items comprising:

a housing with a controller and other components of the printer contained within the housing;

a main chassis having ends and sides, and having a print tray support mechanism and a print tray drive mechanism mounted within the sides and ends of the main chassis;

a print head chassis mounted on top of the main chassis, the print head chassis having a print head unit with a thermal print head and a print head displacement mechanism that raises and lowers the print head during printing operations;

a pivot mechanism interconnecting the print head chassis with the main chassis, the pivot mechanism arranged along a side of the main chassis, wherein the print head chassis and print head unit are pivotable to the side of the main chassis for access to the components of the printer; and a print tray for media items, the print tray having a mask and retainer assembly that retains a selected one of the types of differently shaped media items during printing, the mask having a template configuration structured to compliment the configuration of the selected type of media item, wherein the tray is engageable by the print tray drive mechanism for displacing the tray into and from one end of the main chassis on the print tray support mechanism.

2. The thermal printer of claim 1 wherein the pivot mechanism interconnecting the print head chassis with the main chassis has a stop that limits the pivot of the print head chassis.

3. The thermal printer of claim 1 wherein the pivot mechanism includes an elongated pivot rod with ends and a pair of bracket tabs on the main chassis and a pair of bracket tabs on the print head chassis that pivotally engage the ends of the pivot rod.

4. The thermal printer of claim 1 wherein the print head unit includes a print ribbon supply roll with a print ribbon and a print ribbon take-up roll, the supply roll and take-up roll being mounted to the print head chassis, wherein pivot of the print head chassis facilitates installation of the print ribbon.

5. The thermal printer of claim 4 wherein the print head unit includes a drive motor operably connected to the take-up roller.

6. The thermal printer of claim 4 wherein the print head displacement mechanism includes a displaceable mounting structure to which the print head is mounted, a drive motor and a cam mechanism connecting the drive motor to the displaceable mounting structure.

7. The thermal printer of claim 6 wherein the displaceable mounting structure comprises a carrier sled with a pivot, wherein the carrier sled has a bracket assembly displaced from the pivot and the print head is mounted to the bracket assembly.

8. The thermal printer of claim 7 wherein the cam mechanism has a cam follower mounted on the carrier sled between the bracket assembly and pivot.

9. The thermal printer of claim 8 wherein the carrier sled has a spring assembly means for limiting the pressure that the print head applies to the print tray.

10. A thermal printer for thermal printing on a variety of types of differently shaped media items comprising:

a housing with a controller and internal components of the printer contained within the housing;

a main chassis having ends and sides and having a print tray support mechanism and a print tray drive mechanism mounted within the sides and ends of the main chassis;

a print head chassis arranged on top of the main chassis, the print head chassis having a print head unit with a thermal print head and a print head displacement mechanism that raises and lowers the thermal print head during printing operations;

a removable and replaceable print tray for media items, the print tray having a mask and retainer assembly that retains a selected one of the types of differently shaped media items during printing, the mask having a template configuration structured to compliment the configuration of the selected type of media item, wherein the tray is removable from the printer and has a tracking mechanism mounted on the print tray, the tracking mechanism being engageable with the print tray drive mechanism on installing the print tray in the printer, the tracking mechanism and drive mechanism cooperating to displace the tray into and from one end of the main chassis on the printer tray support mechanism during printing operations.

11. The thermal printer of claim 10 wherein the print tray has an underside and the tracking mechanism on the tray comprises a rack unit having a rack and a guide track and the print tray drive mechanism having a pinion gear and drive motor operably connected to the pinion gear, wherein the pinion gear of the drive mechanism engages the rack and displaces the print tray on operation of the drive motor.

12. The thermal printer of claim 11 wherein the drive motor has a sprocket and the pinion gear has a shaft with a sprocket and the drive mechanism has a belt around the sprocket of the drive motor and the sprocket on the shaft of the pinion gear.

13. The thermal printer of claim 11 wherein the drive mechanism and print tray include a latch mechanism with the drive mechanism in the main chassis having a pivotal latch plate and the tracking mechanism on the print tray including a latch engageable with the latch plate to limit the displacement of the tray from the main chassis.

14. The thermal printer of claim 13 wherein the latch mechanism includes a pivot and the latch plate is mounted on the pivot and has an engagement edge, and wherein the latch has a lead edge and a latch hook, wherein the lead edge of the latch engages the latch plate and rotates the pivot and latch plate and the latch hook subsequently engages the engagement edge on installation of the print tray into the main chassis of the printer.

15. The thermal printer of claim 14 wherein the latch hook engages the engagement edge of the latch plate and limits displacement of the print tray from the main chassis of the printer.

16. The thermal printer of claim 15 wherein the latch mechanism includes a spring that biases the pivot of the latch plate to a pre-engagement position.

17. The thermal printer of claim 13 wherein the latch mechanism includes a latch release, wherein on release of the latch from engagement with the latch plate, the print tray is removable from the printer.

18. The thermal printer of claim 13 wherein the retainer assembly of the print tray includes a displaceable retainer engageable with a media item on the tray, wherein the latch is mounted to the print tray on a pivot and is angularly displaceable within limits, and the displaceable retainer is linked to the latch at a location displaced from the pivot wherein angular displacement of the latch displaces the retainer.

19. The thermal printer of claim 18 wherein the latch mechanism includes a spring, wherein the retainer is spring biased to engage the media item, and when the latch hook is engaged with the latch plate and the print tray displaced from the chassis, the retainer is displaced from the media item against the bias of the spring.

20. A thermal transfer printer for thermal printing on a variety of types of differently shaped media items comprising:

a housing with a controller and other components of the printer contained within the housing;

a main chassis having ends and sides, and having a print tray support mechanism and a print tray drive mechanism mounted within the sides and ends of the main chassis;

a print head chassis arranged on top of the main chassis, the print head chassis having a print head unit with a thermal print head and a print head displacement mechanism that raises and lowers the thermal print head during printing operations;

a print tray for media items, the print tay having a media item retainer and fling mechanism for displacing the tray into and from one end of the main chassis during printing operations;

wherein the print head displacement mechanism includes a carriage assembly having a pivot carrier sled with a pivot end and mount for the print head displaced from the pivot end, the pivot end being pivotally connected to a pivot mounted on the main chassis, and a cam mechanism having one of a cam and cam follower mounted on the pivoted carrier sled, and the other of the cam operation of the cam between a raised position and a lowered printing position.

21. The thermal transfer printer of claim 20 wherein the cam mechanism of the print head displacement mechanism has the cam follower in the form of a roller mounted to the carrier sled and the chassis has a drive motor mount and has the cam in the form of a cam wheel and a connected drive motor, with the drive motor being mounted to the chassis on the drive motor mount, wherein the cam wheel has an eccentric inside cam surface in engagement with the roller on the carrier sled.

22. The thermal transfer printer of claim 21 wherein the cam wheel and drive motor have gears and the cam wheel is connected with the drive motor by the gears.

23. The thermal transfer printer of claim 20 wherein the print head displacement mechanism has a spring assembly connecting the carrier sled at a location displaced from the pivot end to the print head chassis wherein the spring assembly biases the print head toward the printing position.

24. The thermal transfer printer of claim 23 wherein the spring assembly of the print head displacement mechanism has a spring bracket on the carrier sled displaced from the pivot end, a spring bracket on the print head chassis and at least one spring interconnecting the two spring brackets.

25. The thermal transfer printer of claim 24 wherein the displacement mechanism has a plurality of springs interconnecting the spring brackets.

26. The thermal transfer printer of claim 20 wherein the cam mechanism has a signal device that signals the position of the print head to the controller.

* * * * *